US006193570B1

(12) United States Patent
Ishigaki

(10) Patent No.: US 6,193,570 B1
(45) Date of Patent: Feb. 27, 2001

(54) WATER JET PROPULSION SYSTEM FOR WATERCRAFT

(75) Inventor: Eiichi Ishigaki, Kagawa-ken (JP)

(73) Assignee: Ishigaki Company Limited (JP)

( * ) Notice: Subject to any disclaimer, the term of this patent is extended or adjusted under 35 U.S.C. 154(b) by 0 days.

(21) Appl. No.: 09/242,515

(22) PCT Filed: Jun. 18, 1998

(86) PCT No.: PCT/JP98/02692

§ 371 Date: Feb. 17, 1999

§ 102(e) Date: Feb. 17, 1999

(87) PCT Pub. No.: WO98/57849

PCT Pub. Date: Dec. 23, 1998

(30) Foreign Application Priority Data

Jun. 18, 1997 (JP) ..... 9-160330

(51) Int. Cl.[7] ..... B63H 11/00
(52) U.S. Cl. ..... 440/38
(58) Field of Search ..... 440/38–42; 60/221, 60/222

(56) References Cited

U.S. PATENT DOCUMENTS 1,749,087 * 3/1930 Riley ..... 440/40
3,279,704 * 10/1966 Englehart et al. ..... 440/47
3,985,094 * 10/1976 Stricker ..... 440/47

FOREIGN PATENT DOCUMENTS

22222 * 10/1882 (DE) ..... 440/42
50-149093 11/1975 (JP) .
55-127295 10/1980 (JP) .
4-133895 5/1992 (JP) .
4-283196 10/1992 (JP) .
5-294284 11/1993 (JP) .
7-101392 4/1995 (JP) .
9-39888 2/1997 (JP) .

* cited by examiner

*Primary Examiner*—Ed Swinehart
(74) *Attorney, Agent, or Firm*—McDonnell Boehnen Hulbert & Berghoff

(57) ABSTRACT

Water jet ejection nozzles (2, 3, 4) different in ejection bore diameter or controllable of ejection bore diameter are arranged in a vertically spacing manner and fluid paths connected to the ejection nozzles are provided with open-close valves (6, 7, 8) to be individually controlled, or a water jet ejection nozzle (50; 60) having a controllable ejection bore diameter is vertically driven, for water jet propulsion to be in accordance with a varied draft position of a vessel.

4 Claims, 7 Drawing Sheets

T: THRUST

R: RESISTANCE

N: ROTATIONAL SPEED OF IMPELLER

Vs: VESSEL SPEED

η : PROPULSION EFFICIENCY

Vs: VESSEL SPEED

Vj: EJECTION VELOCITY OF WATER JET

WATER JET PROPULSION SYSTEM FOR WATERCRAFT

TECHNICAL FIELD

The present invention relates to a water jet propulsion system for vessels, and more particularly, it relates to a water jet propulsion system for vessels of a displacement type which has streams of water taken in from a bottom of a vessel and changed at an impeller into water jets, and ejects the water jets at a stern of the vessel substantially in parallel with a surface of water, to thereby travel.

BACKGROUND ART

Such a water jet propulsion system for vessels typically has an arrangement in which a single ejection nozzle is fixed to a transversely central part at a stern of a vessel, and water jets to be ejected from the nozzle have an ejection quantity changed, as a rotation speed of an impeller is changed, and an ejection velocity controlled, as a bore diameter of the nozzle is controlled.

The changed ejection quantity of water jets shifts propulsive power of the vessel, and the controlled ejection quantity provides a controlled travel speed.

Accordingly, the ejection quantity and the ejection velocity of water jets are adequately varied in accordance with a weight of loads on the vessel, to thereby enable a saved fuel consumption at a drive for the impeller, allowing an economical travel.

However, the load weight of a vessel has an inseparable relationship to a drafting state of the vessel, such that a lighter load weight provides a shallower draft level, and a heavier load weight provides a deeper draft level.

If the draft is deep, a hull of the vessel has an increased fluid resistance, and besides, water jets hit waves, having a fraction of propulsive power killed, whereas a compensation therefor would cause an inflexible controllability of water jet ejection quantity and ejection velocity.

As a result, the economical travel has conventionally been allowed within a relatively narrow range of load weight.

To this point, there has been proposed an arrangement, which had a pair of ejection nozzles arranged side by side.

This arrangement allowed a sufficient ejection quantity to be secured, with a postponed problem of water jets hitting waves when with a heavy load.

There has been proposed another arrangement, which had a pair of ejection nozzles vertically arranged for a concurrent use, with a wave-hitting problem still left on a lower nozzle.

DISCLOSURE OF INVENTION

The present invention has been achieved with such points in view. It therefore is an object of the invention to provide a water jet propulsion system for vessels, allowing an economical travel, whether the load is much or little.

To achieve the object, according to the invention, there is provided a water jet propulsion system for vessels, comprising jet stream supply means for changing streams of water taken in from a bottom of a vessel into jet streams to supply jet streams in a flow rate variable manner, and water jet ejection means for ejecting supplied jet streams, rearwadly of a stern of the vessel, as velocity-variable water jets along an ejection axis having a variable vertical position.

According to the water jet propulsion system for vessels, the ejection axis of water jets can be vertically shifted in accordance with a varying draft level of the vessel, and the ejection quantity of water jets as well as the ejection velocity is controllable at a shifted position, thus allowing an economical travel, whether the load is much or little.

The water jet ejection means may preferably comprise a plurality of ejection nozzles arranged in a vertically spacing manner, a plurality of valve members provided in fluid paths connected to the plurality of ejection nozzles, and control means adapted to individually control the plurality of valve members, thereby permitting a selective use of an ejection nozzle having an adequate vertical position in accordance with a varying draft level of the vessel.

The plurality of ejection nozzles may preferably include an arbitrary first ejection nozzle, and a second ejection nozzle lower in position than the first ejection nozzle and having a smaller ejection bore diameter than the first ejection nozzle, thereby allowing for an upper ejection nozzle to have a relatively large ejection bore diameter, permitting a relatively large ejection quantity of water jets to be used when the vessel has a deep draft with a heavy load.

The water jet ejection means may preferably further comprise bore diameter control means adapted to control an ejection bore diameter individually of the plurality of ejection nozzles, thereby permitting the water jet ejection velocity to be controlled in a voluntary manner.

The plurality of ejection nozzles may preferably be arranged in a plurality of upper and lower rows, thereby allowing the ejection quantity of water jets to have a relatively large variation at a respective position, and adaptive to a large-scale vessel to be large in variation of load weight.

The water jet ejection means may preferably comprise an ejection nozzle having a controllable ejection bore diameter, and drive means for vertically driving the ejection nozzle, thereby allowing an economical travel of the vessel, whether the load is much or little, in addition to a reduced weight, a reduced construction cost and an improved appearance of the vessel to be expected.

BEST MODE FOR CARRYING OUT THE INVENTION

Figure 1A:
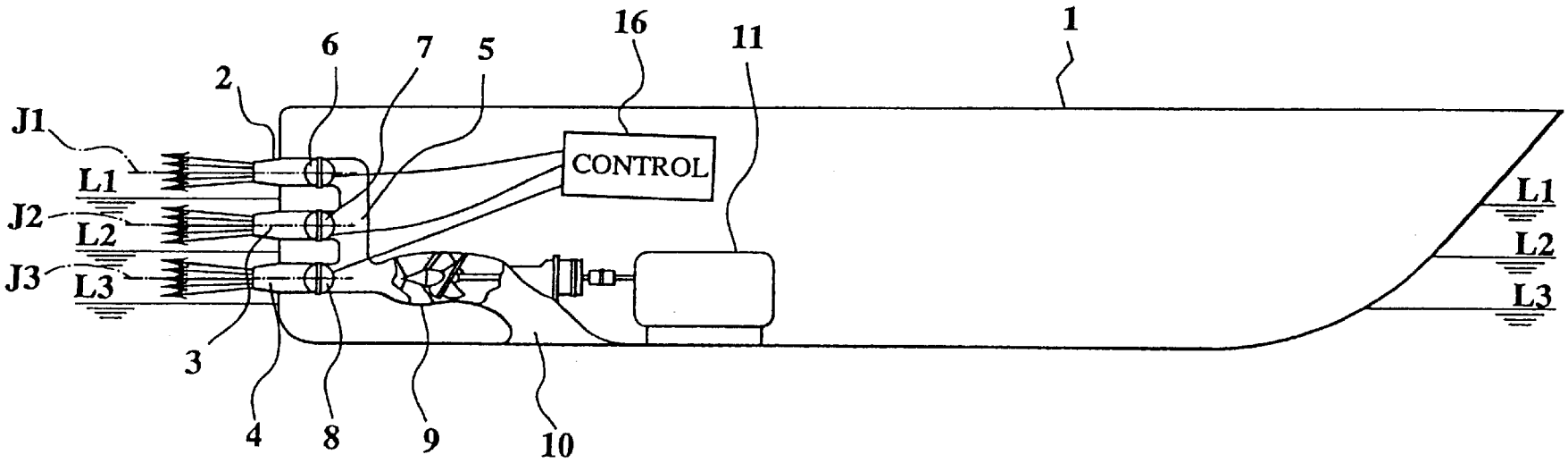
FIG. 1A is a schematic side view of a water jet propulsion system for vessels according to an embodiment of the invention.
Figure 1B:
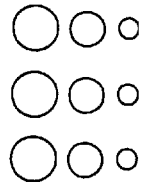
FIG. 1B displays a stern view of the bore diameter arrangement of the plurality of nozzles of the water jet propulsion system shown in FIG. 1A.

FIG. 1 shows a water jet propulsion system for vessels according to an embodiment of the invention. This water jet propulsion system comprises a jet stream supply system (5, 9, 10, 11) for changing streams of water taken in at a bottom of a hull 1 of a vessel into jet streams to supply jet streams in a flow rate variable manner, and a water jet ejection system (2, 3, 4, 6, 7, 8, 16) for ejecting supplied jet streams, rearwardly of a stem of the vessel, as water jets along horizontal ejection axes J1, J2 or J3 different in vertical position.

The jet stream supply system comprises an intake opening 10 for taking in streams of water from a location near the stem at the bottom of the hull 1, an impeller 9 for changing taken streams of water into jet streams to deliver jet streams in a flow rate variable manner, a supply piping 5 for supplying delivered jet streams to a passage branched vertically in three stages and transversely in three columns, and an engine 11 for driving the impeller 9 with a gear-ratio variable multistage gearing.

The water jet ejection system includes a plurality of ejection nozzles 2, 3, 4 spaced vertically in three stages (upper, middle, lower) and transversely in three columns (port, central, starboard) to be arranged at the stem, vertically three stages and transversely three columns of normally close type open-close valves 6, 7, 8 installed in jet stream supplying branched paths connected to the ejection nozzles, and a control system 16 adaptive for individual control of the valves.

Ejection nozzles 2 in the upper stage have a large-diameter ejection bore, ejection nozzles 3 in the middle stage, a middle-diameter ejection bore, and ejection nozzles 4 in the lower stage, a small-diameter ejection bore. Each stage may preferably comprise an ejection nozzle merely of a central column.

The control system 16 has, in a vessel steering cabin, a display for displaying a detected value of a draft of the hull 1 and shipment data representative of an amount of loads.

When the load has a large weight and the draft is a deep level L1, valves 6 are opened to eject water jets from the ejection nozzles 2. After reduction in load weight, if the draft is a normal level L2, valves 7 are opened to eject water jets from the ejection nozzles 3. If the draft is a shallow level L3, as the vessel is in an unloaded state or similar state thereto, valves 8 are opened to eject water jets from the ejection nozzles 4.

While at the deep draft L1, strong propulsive power (drive power) is needed, not simply for a heavy weight transfer, but also because of an increased water fluid resistance of the hull 1. To this point, the ejection nozzles 2 are large in bore diameter, and eject a large quantity of water jets, achieving a sufficient propulsive force.

At the shallow draft L3, the vessel is in an unloaded state, where the hull 1 has a relatively small resistance, and the ejection nozzles 4 with a small bore diameter can cope with.

The ejection nozzles 2 to 4 are selected for use in accordance with a shipping load, permitting an economical travel.

Figure 2:
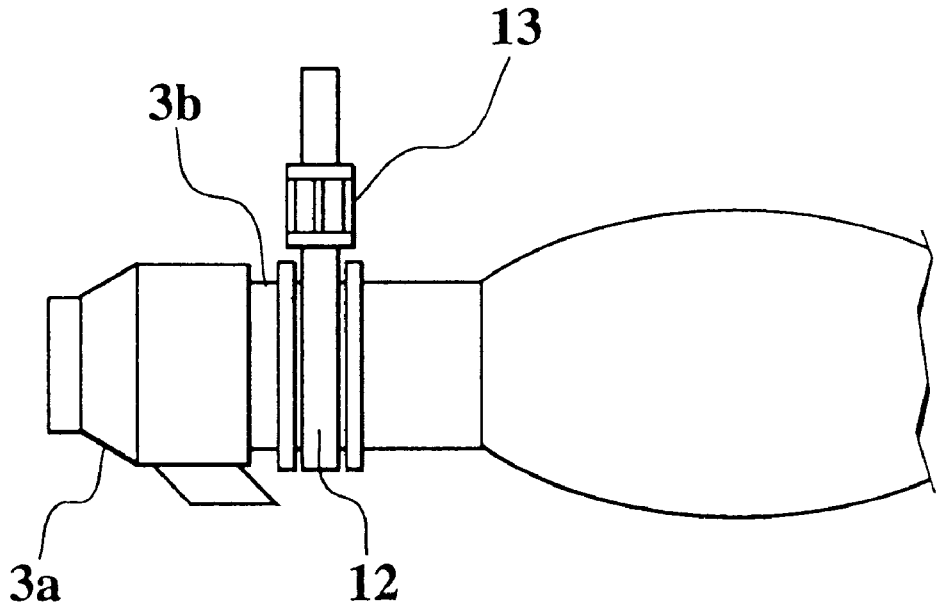
FIG. 2 is a side view of an ejection nozzle of the water jet propulsion system for vessels according to the embodiment of the invention.
Figure 3:
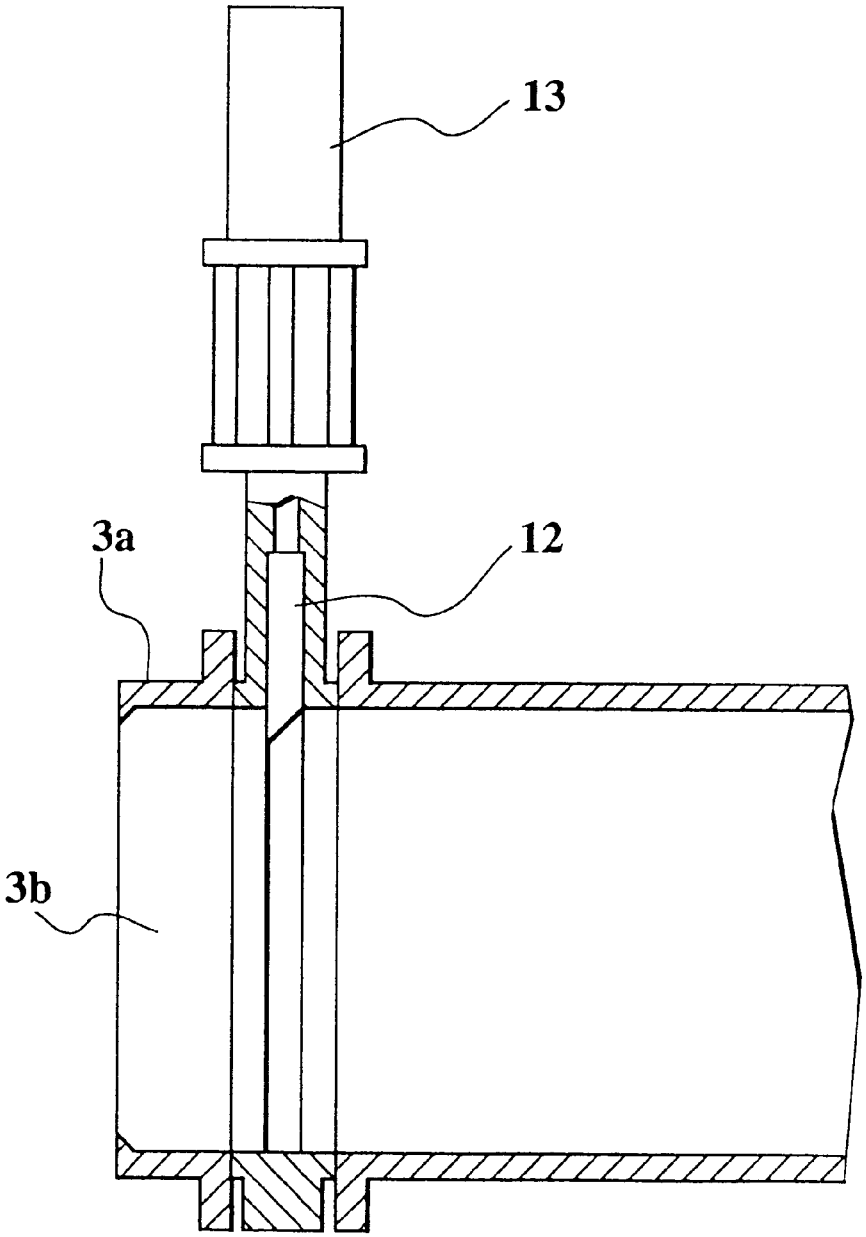
FIG. 3 is a longitudinal section of an essential portion of the ejection nozzle of FIG. 2.
Figure 4:
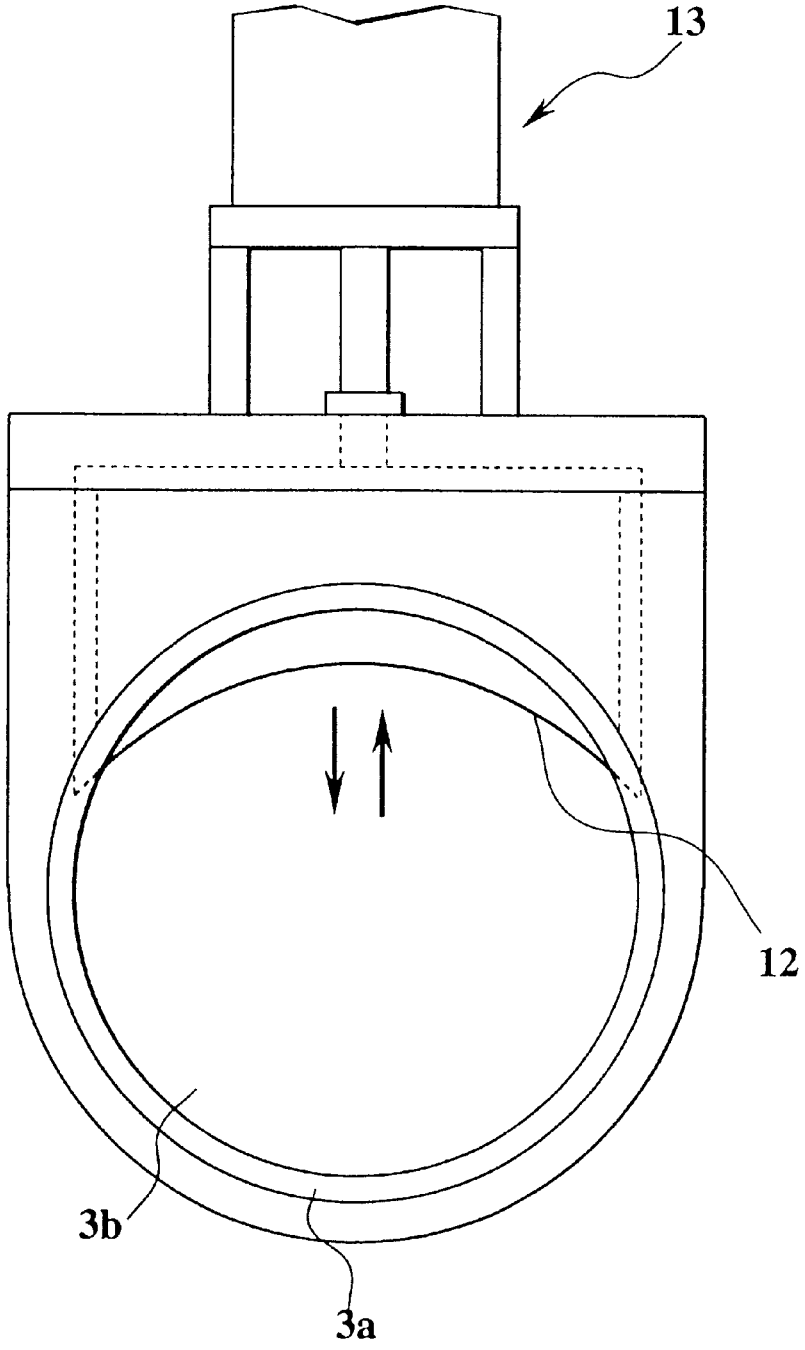
FIG. 4 is a front view of the ejection nozzle of FIG. 2.

FIGS. 2 to 4 show a slide valve 12 adapted for diameter control of ejection bores of the ejection nozzles 2 to 4.

As a tip-end cylindrical part for a nozzle body 3*a*, a lancer 3*b* has the slide valve 12 installed therein, which slide valve 12 is vertically driven for a throttling of ejection bore diameter. Drive control for the slide valve 12 is effected by with a hydraulic cylinder 13, and a hydraulic system for the hydraulic cylinder 13 is controlled by the control system 16. The bore diameter of ejection nozzles 2, 3, 4 selected in dependence on a draft is additionally controllable, allowing for the engine 11 to work with an optimum efficiency by ejection control in accord with load weight and travel speed. Incidentally, for some vessels, the ejection nozzles 2–4 may preferably have an identical bore diameter subjected to bore diameter control by slide valves 12.

Figure 5:
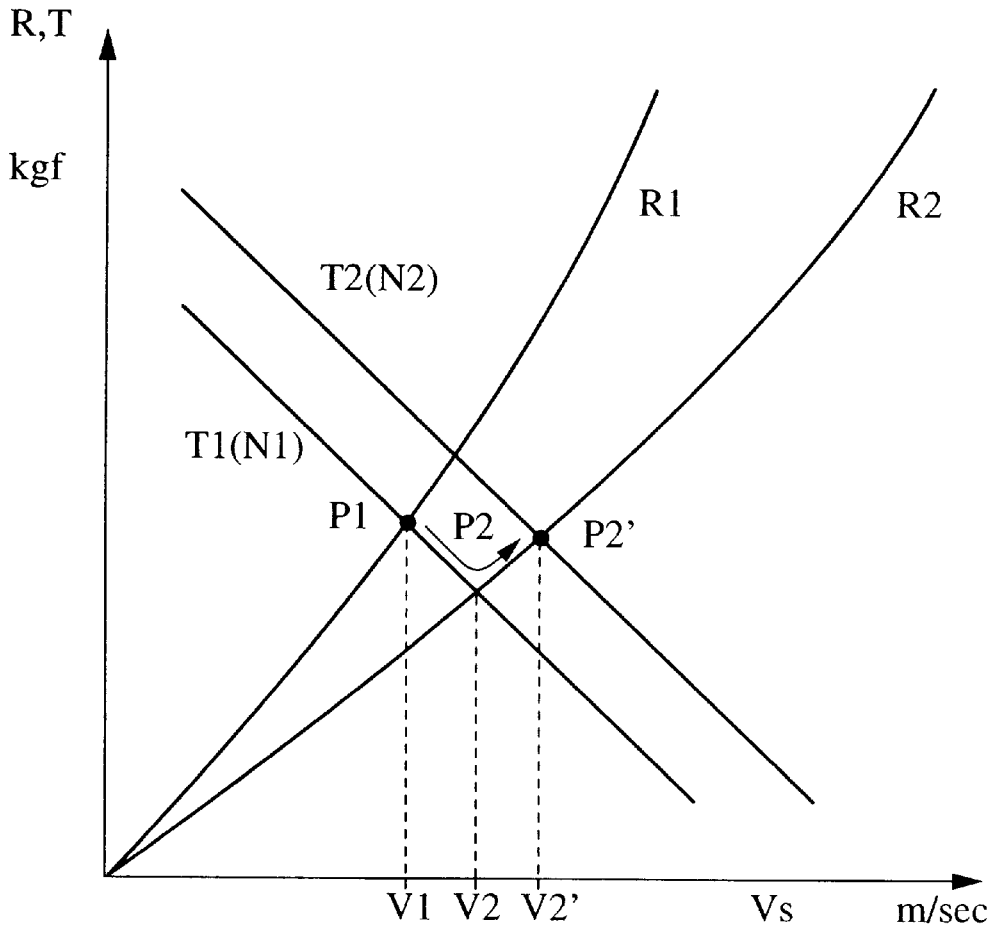
FIG. 5 is a graph describing actions of the water jet propulsion system for vessels according to the embodiment of the invention.

FIG. 5 shows relationships between a thrust T (propulsive force) of water jets and a fluid resistance R of the hull 1 and a travel speed Vs [m/sec] of the vessel.

As the vessel speed Vs increases, the resistance R of the hull 1 increases with a steep gradient, and the thrust T of water jets decreases, as the impeller's suction rate is increased with the increasing vessel speed Vs.

Designated by R1 is a hull resistance R when at a deep draft, and R2 is a hull resistance R when at a shallow draft. When traveling with a thrust T1 (impeller revolution number N1), if at the deep draft (resistance R1), the impeller revolution number is balanced with the resistance at a vessel speed V1 (coordinate P1), and if at the shallow draft (resistance R2), it is balanced at a vessel speed V2 (coordinate P2). This means, in the case of a shallow draft, the impeller with light load has an excessive revolution, tending to cause cavitations. Then, the lower-staged ejection nozzles 4 are employed (or nozzle diameters are throttled), to thereby enable an efficient travel (vessel speed V2') with a balanced state (coordinate P2') between thrust and resistance.

Figure 6:
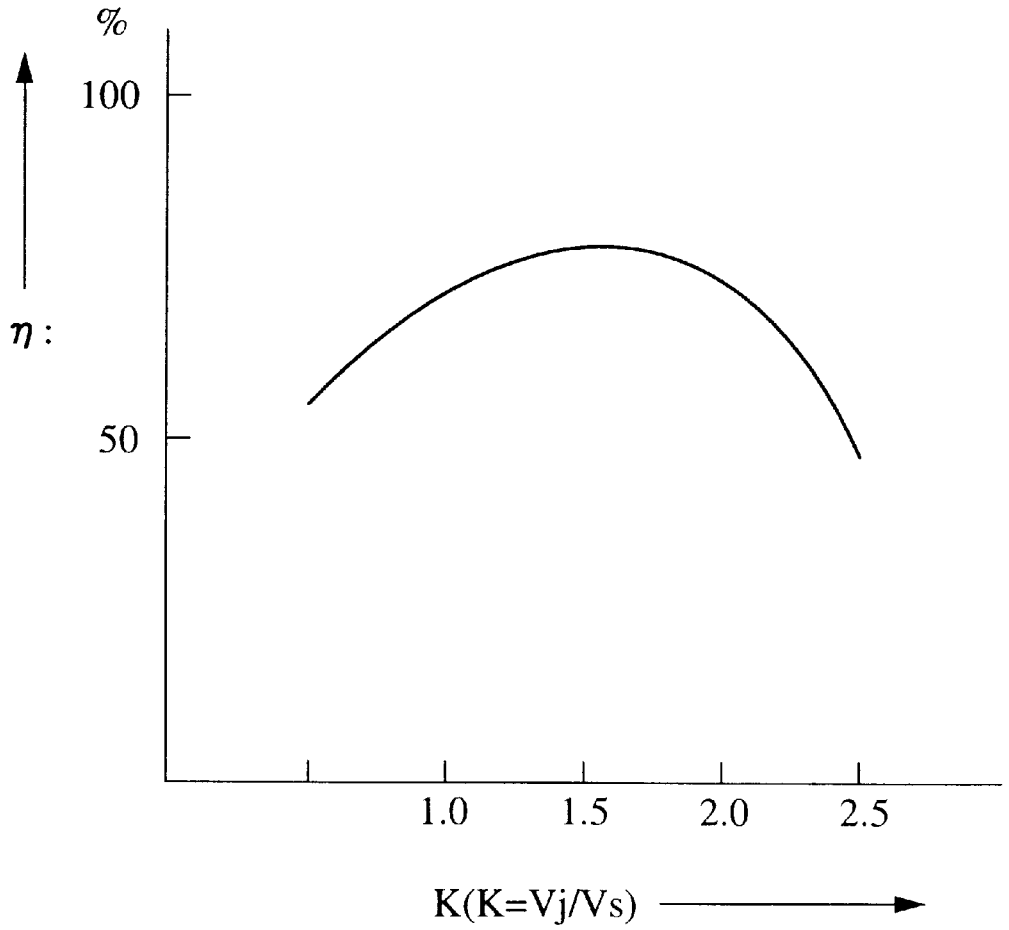
FIG. 6 is a graph describing a variation in propulsion efficiency of an impeller of the water jet propulsion system for vessels having actions described in FIG. 5.

FIG. 6 shows a relationship between the impeller's propulsion efficiency and a change in ratio of a water jet ejection velocity Vj to the vessel speed Vs. The water jet propelling vessel has, between water jet ejection velocity Vj and vessel speed Vs, a ratio range (K=1.5 to 6, where K=Vj/Vs) for propulsive power to be efficiently obtained.

Changing the ejection velocity Vj relative to the vessel speed Vs can be achieved by selection/control of ejection bore diameter, and the present embodiment allows for propulsive power to be obtained with high efficiency in dependence on a varying draft, permitting an economical travel.

Figure 7:
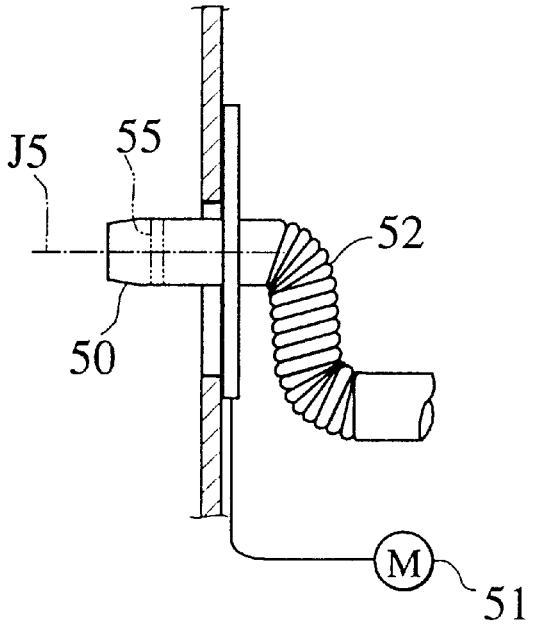
FIG. 7 is a schematic sectional view of an ejection nozzle of a water jet propulsion system for vessels according to an embodiment of the invention.
Figure 8:
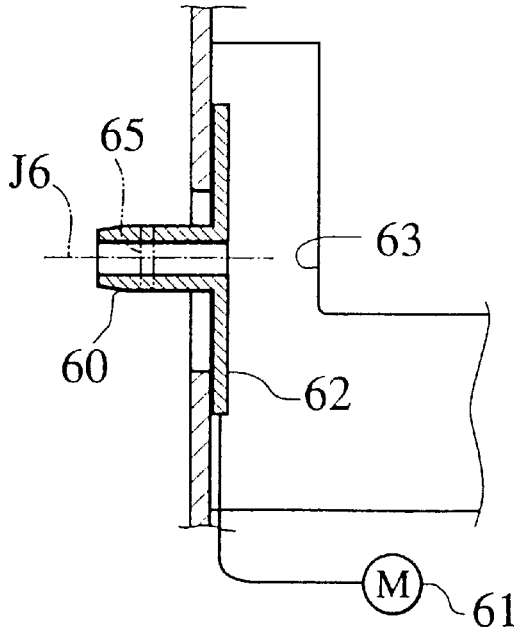
FIG. 8 is a schematic sectional view of an ejection nozzle of a water jet propulsion system for vessels according to an embodiment of the invention.

FIGS. 7 and 8 show embodiments having ejection nozzles 50, 60 constituted as vertical slide types for reduction in number of nozzles.

The ejection nozzle 50 is level-controlled with a motor 51 connected to a control system (16), for ejecting jet streams, as they are introduced from a flexible tube 52 and velocity-controlled by an adjustable throttle 55 controllable from the control system (16), rearwardly of a stem in the form of water jets along a horizontal axis J5.

For the ejection nozzle 60, a nozzle holding plate 62 is water-tightly level-controlled with a motor 61 connected to a control system (16). Jet streams introduced from a vertical duct 53 are velocity-controlled by an adjustable throttle 55 controllable from the control system (16), and are ejected rearwardly of a stem in the form of water jets along a horizontal axis J6.

The ejection nozzles 50, 60 may preferably be arranged in rows, or serve in combination with or substitute for an arbitrary array of ejection nozzles 2 to 4.

Industrial Applicability

According to the invention, vessels equipped with water jet propulsion systems can economically travel, whether their loads are much or little, and have greatly reduced traveling costs, with fuel consumption inclusive, and significant contribution may be provided for profits to be enhanced in vessel flight services.

What is claimed is:

1. A water jet propulsion system for vessels, comprising:

a jet stream supply means for changing streams of water taken in from a bottom of a vessel into jet streams supplied with a variable flow rate to a water jet ejection means; and water jet ejection means for ejecting supplied jet streams rearwardly to a stern of the vessel as velocity-variable water jets along an ejection axis having a variable vertical position, wherein the water jet ejection means comprises a plurality of ejection nozzles including a first ejection nozzle and a second ejection nozzle lower in position than the first ejection nozzle, the second ejection nozzle having a smaller ejection bore diameter than the first ejection nozzle.

2. The water jet propulsion system for vessels of claim 1, wherein the water jet ejection means comprises the plurality of ejection nozzles arranged in a vertically spaced manner, a plurality of valve members provided in fluid paths connected to the plurality of ejection nozzles, control means adapted to individually control the plurality of valve members, and bore diameter control means adapted to control an ejection bore diameter independently of the other ejection nozzles.

3. The water jet propulsion system for vessels of claim 2, wherein the plurality of ejection nozzles are arranged in a plurality of upper and lower rows (2, 3, 4; 2, 3, 4).

4. The water jet propulsion system for vessels of claim 1, wherein the water jet ejection means comprises the plurality of ejection nozzles including a third ejection nozzle having a controllable ejection bore diameter, and drive means for vertically driving the third ejection nozzle.

* * * * *